United States Patent [19]

Mauer et al.

[11] Patent Number: 4,662,206

[45] Date of Patent: May 5, 1987

[54] RIVET/STUD FEEDER

[75] Inventors: Dieter Mauer, Lollar; Wolfgang Clauss, Niedernhausen-Engenhahn, both of Fed. Rep. of Germany

[73] Assignee: USM Corporation, Farmington, Conn.

[21] Appl. No.: 803,365

[22] Filed: Dec. 2, 1985

[30] Foreign Application Priority Data

Dec. 3, 1984 [DE] Fed. Rep. of Germany ..... 3444025

[51] Int. Cl.[4] ..... B21J 15/03

[52] U.S. Cl. ..... 72/391; 227/107; 227/112

[58] Field of Search ..... 72/114, 391, 453.17, 72/453.16, 424; 29/243.53, 809; 227/51, 107, 111, 110, 112, 139

[56] References Cited

U.S. PATENT DOCUMENTS

| | | | |
|---|---|---|---|
| 1,264,963 | 5/1918 | Myers | 227/139 |
| 2,493,868 | 1/1950 | Griffin | 72/453.17 |
| 2,506,994 | 5/1950 | Chadwick | 227/112 |
| 3,049,713 | 9/1962 | Depuy et al. | 227/112 |
| 3,802,617 | 4/1974 | Berecz | 227/112 |
| 4,035,900 | 7/1977 | Boyko et al. | 29/809 |

*Primary Examiner*—R. L. Spruill
*Assistant Examiner*—David B. Jones
*Attorney, Agent, or Firm*—Alan N. McCartney

[57] ABSTRACT

A fastener-installing tool comprises a housing in which a collet which holds a fastener moves back and forth between a forward fastener-installing position and a rear loading position. A curved feed tube is pivoted on the housing to swing about its center of curvature into a fastener delivering position in front of the retracted collet to feed into it a fresh fastener delivered through a hose from a supply. The feed tube swings out of the path of the collet when it next advances.

7 Claims, 6 Drawing Figures

RIVET/STUD FEEDER

BACKGROUND OF THE INVENTION

This invention is concerned with a fastener-installing tool comprising presenting means (e.g. a nosepiece) for receiving an elongated fastener element (e.g. a blind-riveting assembly, weld stud) and holding it with one end exposed for presentation to a workpiece, the presenting means being mounted for axial reciprocation between fastener-receiving and fastener-installing positions, and delivery means by which fasteners are conveyed from a delivery end of a supply source to said presenting means when retracted to its fastener-receiving position.

The installation of fasteners, (e.g. blind-riveting assemblies and weld studs), especially fasteners such as those which have cylindrical shanks with radially projecting flanges, require to be presented to the workpiece by means, e.g. a nosepiece, which closely embraces the shank. It is often also desirable that such means surrounds the shank completely, or as completely as possible, especially if the means, as is the case with a nosepiece in blind riveting, is going to apply pressure to the flange of the fastener.

Fasteners can be fed to the presenting means of tools of the kind under consideration either from the front or from inside the tool, and automatic means of both types have been proposed. In the latter type, while external attachments near the presenting means such as might impair the maneuverability of the tool may be avoided, it follows that the presenting means itself must be openable to allow the flange of the fastener to pass through it, either before or after the installing operation, depending on the particular fastener and operation. A split nosepiece is commonly used in such circumstances, but has the disadvantages of complexity and susceptibility of becoming jammed against closing properly compared with a solid nosepiece such as can be used if the fastener is fed into it from the front.

A proposal for a front-feeding arrangement for blind-riveting tools is described in U.S. Pat. No. 4,059,981. In U.S. Pat. No. 4,065,952 there is shown a feeding unit inside the tool.

The foregoing proposals offer a variety of arrangements for the automatic front-feeding of blind-riveting assemblies. All are subject to limitation as to their suitability because of the space they occupy or require in operation, their cost or complexity, or their operational efficiency. Similar considerations applies to the front feeding of stud welding tools. It is accordingly an object of the present invention to provide a fastener-inserting tool of the kind referred to with improved means for the reloading of the presenting means from the front between a successive installing operation.

OBJECTS OF THE INVENTION

It is one of the various objects of the invention to provide a fastener-installing tool of the kind referred to with improved means for reloading the presenting means from the front between successive installing operations.

The invention provides a fastener-installing tool comprising presenting means (e.g., a nosepiece) for receiving an elongated fastener element (e.g., a blind-riveting assembly, weld stud) and holding it with one end exposed for presentation to a workpiece, the presenting means being mounted for axial reciprocation between fastener-receiving and fastener-installing positions, and delivery means by which fasteners are conveyed from a delivery end of a supply source to said presenting means when retracted to its fastener-receiving position, characterized in that said delivery means comprises a curved conduit moveable into and out of a fastener-delivery position in which its discharge end is in alignment with the presenting means and which provides a passage for the fasteners from said delivery end of the supply source to said presenting means, said conduit following an arc of a circle and being mounted to rock about the axis of said arc between its delivery position and a retracted position out of the path of reciprocation of the presenting means.

Preferably, a tool as set out in the last preceding paragraph and adapted for co-operation with the delivery end of a supply source provided by a tube through which the fasteners are conveyed lengthwise, as the inlet end of said conduit inclined to its axis so that it can lie close to a complimentarily inclined delivery end of said tube when the conduit is in its fastener delivery position, thereby to allow rocking of the conduit without it being impeded by said tube when it is retracted out of the path of the presenting means.

Preferably, also, a tool as set out in the last preceding paragraph but one as the inner wall of the conduit constituted by side faces which converge towards an apex at its outer periphery, thereby to provide at least two separate lines of contact with a fastener passing through the conduit.

A tool in accordance with the invention may have its conduit rocked about its axis by means of a drive member moveable along the path of the presenting means. The conduit may be moved to and from under the influence of air pressure, preferably through a rack and pinion mechanism. Alternatively, the conduit may be rocked about its axis by means of a rotary vane motor.

There now follows a description to be read with reference to the accompanying drawings, of fastener-delivering means of a stud welding tool in accordance with the invention and illustrative thereof. It will be realized that this illustrative arrangement has been selected for description by way of example and not of limitation of the invention.

DESCRIPTION OF THE PREFERRED EMBODIMENT

Figure 1:
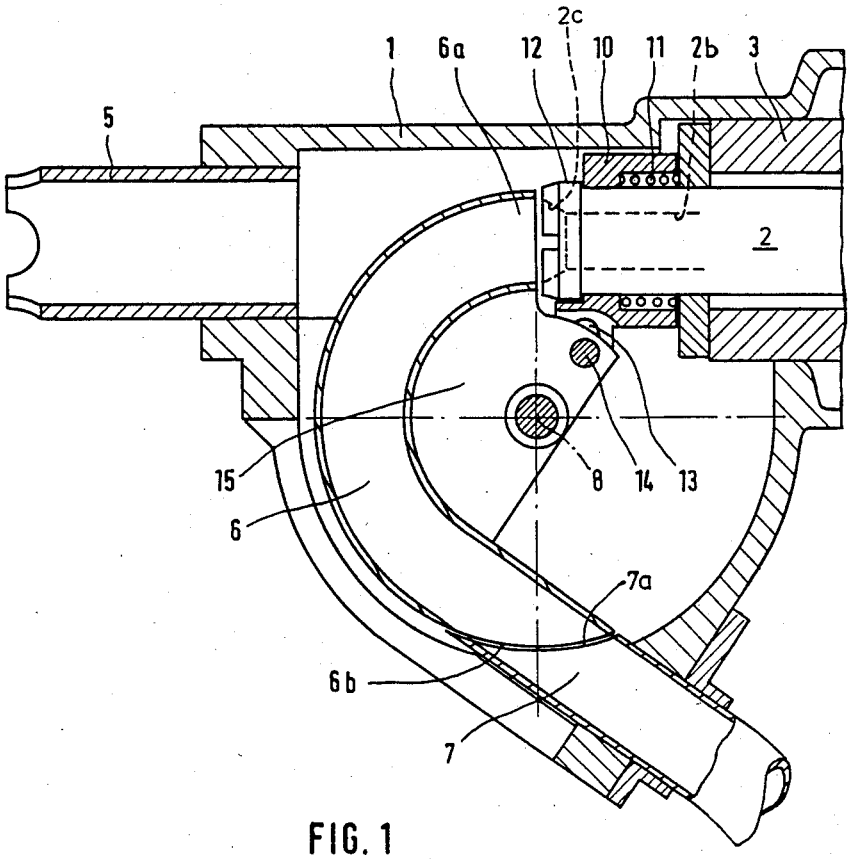
FIG. 1 is a simplified view in longitudinal section of a front end portion of a first exemplary embodiment of a tool in accordance with the invention showing the presenting means in its fastener-receiving position, and the delivering means in its fastener-delivery position.
Figure 2:
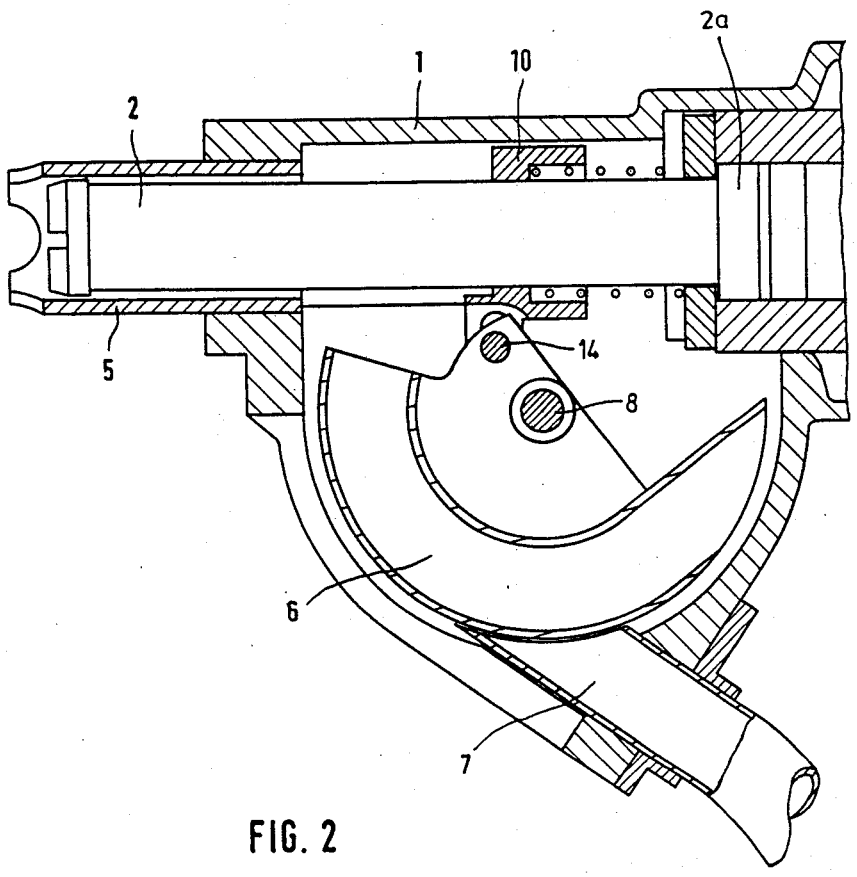
FIG. 2 is a view similar to FIG. 1 but showing the presenting means in its fastener-installing position.

In FIGS. 1 and 2, there is shown a front end portion of a stud welding tool comprising a housing 1 including a flash guard 5 and, within the housing, a double-acting pneumatic cylinder 3 in which stud presenting means in the form of a stud welding collet 2 with a piston 2*a* at its rear end is reciprocable. The collet 2 has an axial bore 2*b* leading from its front end, where the bore has a conical mouth 2*c* to facilitate the entry of a weld stud. The foregoing construction is conventional for stud welding tools and will not be further described herein.

The housing 1 of the tool depicted in FIGS. 1 and 2 has a hollow, flat sided, depending portion which provides support for a transverse pin 8 on which a conduit 6 of delivery means of the tool is mounted to rock. The conduit is circular in cross section and bent into an arc of a circle with its center on the axis of the pin 8. The discharge end 6*a* of the conduit lies in axial register with the collet 2, when the collet is in its stud receiving position shown in FIG. 1, while its inlet end 6*b* registers with the delivery end of stud supply means indicated by a tube 7 through which studs are fed lengthwise one by one. The supply mean is of conventional construction and therefore not further described herein. Opposing end faces 7*a* and 6*b* of the tube 7 and conduit 6 respectively are inclined to their axes, and slightly curved, so that, while there is a negligible gap between them when in the relationship shown in FIG. 1, and thus no interference with the passage of a stud from the tube to the conduit, rocking of the conduit 6 to the position shown in FIG. 7 is not impeded. In the position shown in FIG. 7, the conduit is out of the path of the collet, which has advanced to present a stud (not shown) carried thereby to a workpiece, and is seen to be blocking the exit from the tube 7.

Means for rocking the conduit 6 about the pin 8 is shown in FIG. 1 to comprise a collar 10 loosely mounted on the collet 2 and urged by a spring 11 against a flange 12 at the front end of the collet. The collar 10 has a depending lug with a vertical slot 13 in it, in which is accommodated a pin 14 projecting from a supporting plate 15 to which the conduit is secured. Thus advance of the collet 2 from its stud receiving position shown in FIG. 1 to its stud presenting position shown in FIG. 2 results first in the conduit 6 swinging out of the path of movement of the collet, the pin being pushed by the collar 10 until the spring 11 is fully extended and the collet 2 continues to advance without it.

Figure 3:
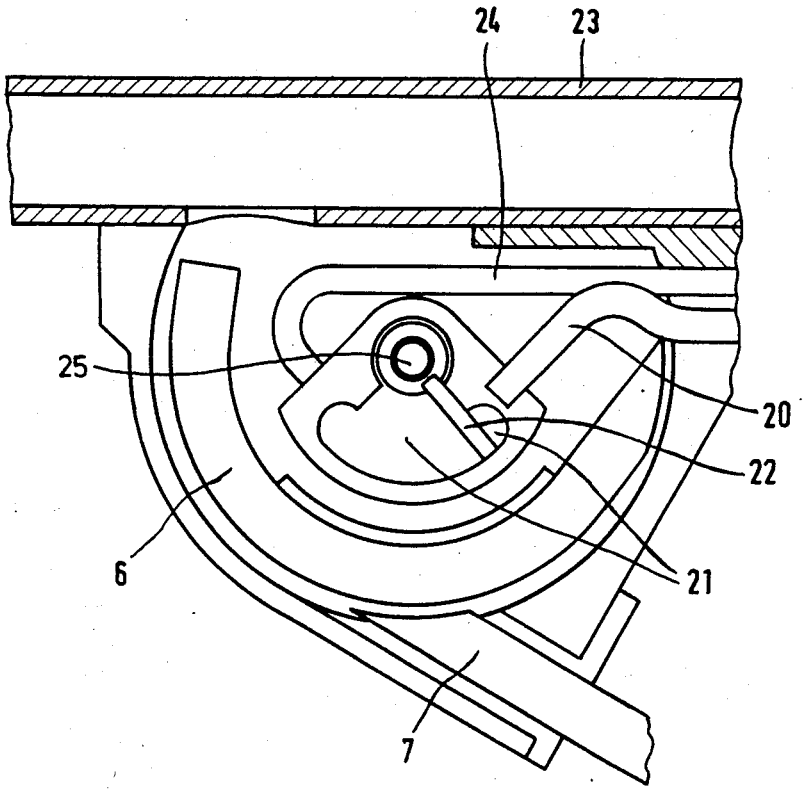
FIG. 3 is a simplified depiction in longitudinal section of a pneumatic drive mechanism of the delivery means of a tool in accordance with the invention.

A modification of the means for locking the conduit is shown in FIG. 3 where, instead of the collar 10 and spring 11, a double-acting rotary air vane motor is provided. The motor has an arcuate chamber 21 with a vane 22 arranged to swing in it about a pivot 25 to which the conduit 6 is secured, air pipes 22,24 leading to the chamber 21 at either side of the vane 22. Rocking of the conduit 6 by the vane motor is arranged to occur in time relation to advance and retraction of the collet in a sleeve portion 23 of the housing of the tool.

Figure 4:
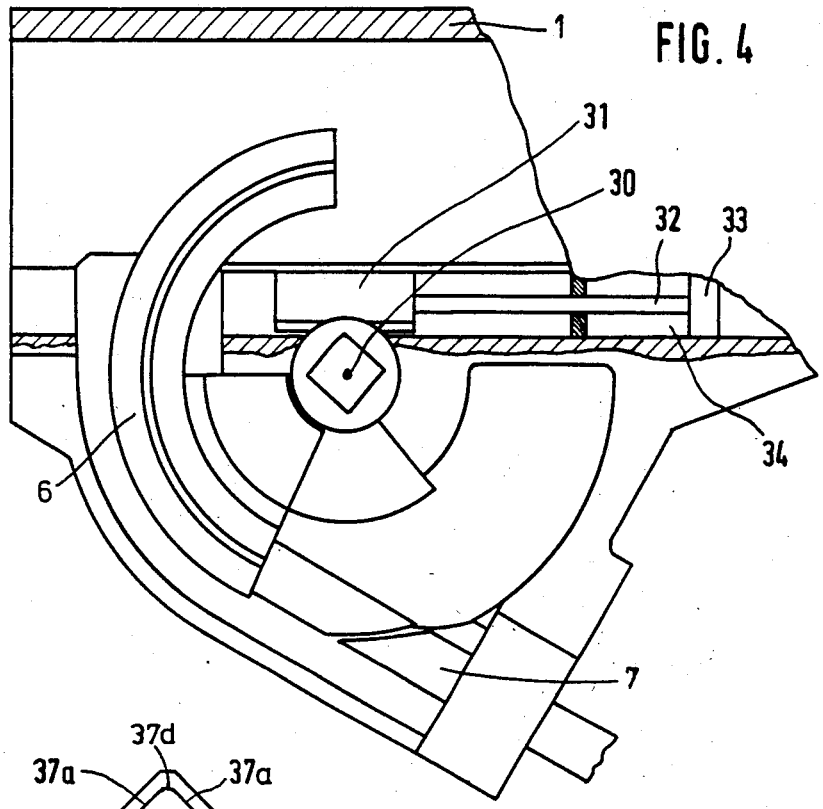
FIG. 4 is a simplified depiction in longitudinal section of another exemplary embodiment of a pneumatic drive mechanism of the delivery means of a tool in accordance with the invention.

In FIG. 4 there is shown a further modification of the tool. In this modification, the conduit is rocked by a rack and pinion mechanism 31,30 actuated by a double-acting air cylinder 34. A piston 33 slides in the cylinder 34 and its rod 32 is secured to the toothed rack 31.

Figure 5:
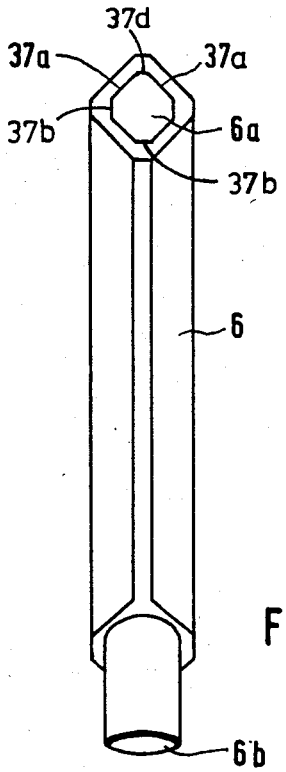
FIG. 5 is in a view of a conduit of the delivery means shown in FIG. 4.
Figure 6:
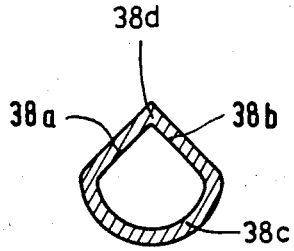
FIG. 6 is a cross section through another conduit suitable for a tool in accordance with the invention.

The conduit 6 shown in FIG. 4 has also been modified as depicted in FIG. 5, it being circular in cross section at its inlet and 6*b* but octagonal in cross section over at least two thirds of its length extending from its discharge end. The octagon of its cross section is symmetrical about its axis with four wide walls 37*a* alternating with four narrow ones 37*b*. A further alternative modification of the conduit 6 is indicated in FIG. 6, where the cross section is shown shaped as a sector of a circle, that is to say with two radial walls 38*a* and 38*b* joined at their free ends by an arcuate wall 38*a*. In the case of both conduits shown in FIGS. 5 and 6, the conduit 6, on the outer side of its curvature, walls 37*a* in FIG. 6*a*, and 38*a* and 38*b* in FIG. 7, which converge towards an apex 37*d* and 38*d* respectively at its outer periphery. In both cases, these converging walls ensure that as a fastener element which is round in cross section and may have a circular flange progresses towards the discharge end of the conduit it will contact the conduit along at least two separate lines, thus restraining its tendency to tumble about in the air stream. The conduit 6 may be of other cross sectional shapes, for example a shape complementary to that of a fastener which is other than circular (e.g. flat) where it is desired to control the orientation of the fastener in collet 2.

In the operation of the tool, after welding a stud to a workpiece, the collet 2 retracts, the conduit 6 swings up into the position shown in FIG. 1 where it provides a path to guide the fastener elements from the tube 7 to the retracted collet 2, and the collet advances to its fastener-presenting position, its advance resulting first in the conduit swinging out of the path of the collet and blocking the exit from the tube 7 until the tool is ready for another fastener element to be fed to the collet.

We claim:

1. A tool for installing a fastener element having a shank end and an opposite end with a flange comprising: presenting means including a nose piece located at the front of the tool for receiving the shank end of the fastener element and holding it with the flange end exposed for presentation to a workpiece, the presenting means being mounted for axial reciprocation between fastener-receiving and fastener-installing positions, and delivery means exterior of said presenting means by which fasteners are conveyed from a delivery end of a supply source to said presenting means at the front of the presenting means when retracted to its fastener-receiving position, characterized in that said delivery means comprises a curved enclosed conduit moveable into and out of a fastener-delivery position in which its discharge end is in alignment with the front of said presenting means and which provides a passage for the fasteners from said delivery end of the supply source to the front of said presenting means, said conduit following an arc of a circle and being mounted to rock about the axis of said arc between its delivery position and a retracted position out of the path of reciprocation of the presenting means.

2. A tool according to claim 1 further characterized in that, for co-operation with the delivery end of a supply source is provided by a tube through which the fasteners are conveyed lengthwise, the inlet end of said conduit is inclined to its axis so that it can lie close to a complimentarily inclined delivery end of said tube when the conduit is in its fastener-delivery position, thereby to allow rocking of the conduit without being impeded by said tube when it is retracted out of the path of the presenting means.

3. A too1 according to claim 1 further characterized in that the inner wall of the conduit has side faces which converge towards and apex at its outer periphery, thereby to provide at least two separate lines of contact with a fastener passing through the conduit.

4. A tool according to claim 1 further characterized in that said conduit is rocked about its axis by means of a drive member moveable along the path of the presenting means.

5. A tool according to claim 1 further characterized in that said conduit is moved to and from under the influence of air pressure.

6. A tool according to claim 1 further characterized in that said conduit is rocked about its axis through a rack and pinion mechanism.

7. A tool according to claim 1 further characterized in that said conduit is rocked about its axis by means of a rotary vane motor.

* * * * *